US005709119A

United States Patent [19]

Palzer

[11] Patent Number: 5,709,119

[45] Date of Patent: Jan. 20, 1998

[54] METHOD AND ARRANGEMENT FOR THE CONTROLLED FORMATION OF ROLLING STOCK LOOPS

[75] Inventor: Otmar Palzer, Haan, Germany

[73] Assignee: SMS Schloemann-Siemag Aktiengesellschaft, Dusseldorf, Germany

[21] Appl. No.: 400,240

[22] Filed: Mar. 3, 1995

[30] Foreign Application Priority Data

Mar. 10, 1994 [DE] Germany ..... 44 07 981.8

[51] Int. Cl.[6] ..... B21B 41/00; B21B 39/20

[52] U.S. Cl. ..... 72/250; 72/227

[58] Field of Search ..... 72/8.6, 8.8, 11.4, 72/205, 250, 227

[56] References Cited

U.S. PATENT DOCUMENTS 3,592,035 7/1971 Buccicone ..... 72/250
4,033,492 7/1977 Imai ..... 72/205
4,123,011 10/1978 Kajiwara et al. ..... 72/250
4,876,875 10/1989 Bruggeman et al. ..... 72/250

*Primary Examiner*—Lowell A. Larson
*Assistant Examiner*—Rodney A. Butler
*Attorney, Agent, or Firm*—Friedrich Kueffner

[57] ABSTRACT

A method and an arrangement for the controlled formation of loops of rolling stock between two roll stands, particularly in the finishing or intermediate trains of small and medium iron trains. In the method, the rolling stock emerging from the roll stand is allowed to drop as a result of gravity, the front end of the rolling stock is then deflected in the direction of the subsequent roll stand and the rolling stock is temporarily supported during the deflection phase until the front end of the rolling stock has entered the subsequent stand and the loop control unit stabilizes the loop. The arrangement for carrying out the above-described method includes a support and guide member for at least the rear roll stand of two roll stands. The support and guide member is inclined downwardly and extends toward the front roll stand.

3 Claims, 1 Drawing Sheet

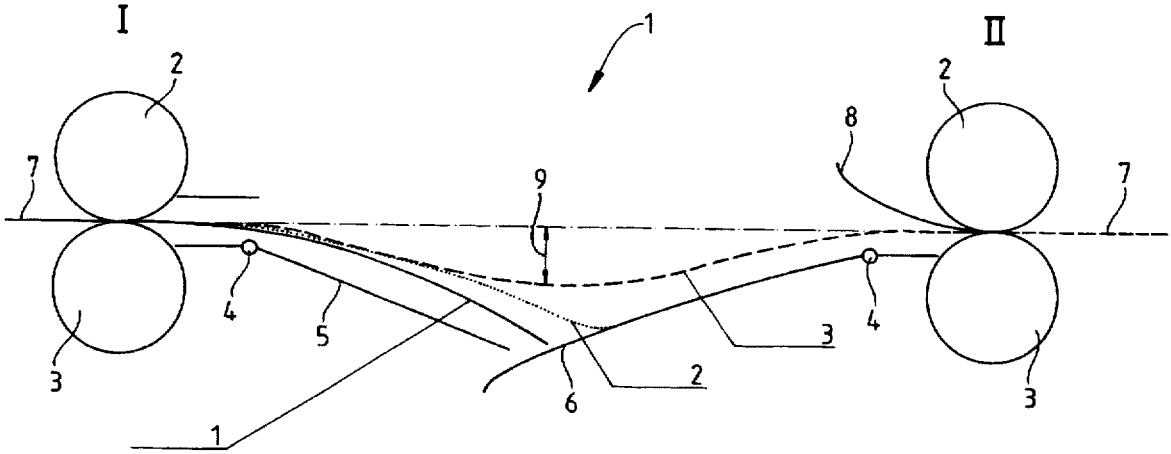
I
II
1
2
2
7
7
8
9
4
4
5
3
3
3
2
6
1

METHOD AND ARRANGEMENT FOR THE CONTROLLED FORMATION OF ROLLING STOCK LOOPS

BACKGROUND OF THE INVENTION

1. Field of the Invention

The present invention relates to a method and an arrangement for the controlled formation of loops of rolling stock between two roll stands, particularly in the finishing or intermediate trains of small and medium iron trains.

2. Description of the Related Art

In known rolling trains, vertical or horizontal loops are formed between the roll stands when the rolling stock travels through the finishing group in order to ensure that rolling is carried out without tension between two successive stands. The loop lifting units which are used for this purpose and facilitate the increase and decrease of the loop between two roll stands are composed of horizontal loop formers with an ejector roll which is swung out by means of at least one pneumatic cylinder or hydraulic cylinder. If a vertical loop former is also provided, the ejector roll for the vertical loop can be driven and swung out for the loop formation by means of a lever linkage and a pneumatic or hydraulic cylinders hinged to the lever linkage.

The example of a small steel train, in which one loop is formed between two stands during rolling, clearly demonstrates the relatively high number of units and the drive technology, control technology and regulating technology required for rolling without tension. The front end of the rod or bar enters a straight guide means between the two stands. For forming the loop, the peripheral speed or rate of rotation of the rolls of the subsequent stand must be smaller than that of the preceding stand when the front end of the rod or bar is grasped by the subsequent stand.

At the same time, the loop formed as a result of the speed difference between the two stands is deflected by a roll lever from the straight guide means onto the looping table. It must be observed in this connection that the formation of the loop between the two stands must be concluded at the latest when the front end of the rod or bar has reached the stand following the two stands and a new loop formation is started.

The above-described procedure is supported by a loop control unit which is used for forming the loop and for maintaining the loop constant at a predetermined value during rolling. The loop control unit limits the two horizontal or end positions of the loop and holds the loop as much as possible at a predetermined value in the middle of the looping table. Taken into consideration during this procedure are the influences occurring during the rolling process, such as, changes in cross section, for example, as a result of changing processing in the preceding multiple-strand stands, the temperature of the rolling stock, etc., which cause changes in length and, thus, changes in the loop size. The loop control unit is released after the deflection of the loop by the roll lever; the loop control unit operates with the aid of photoelectric scanning of the rolling stock and controls the rate of rotation of the preceding roll stand or the subsequent roll stand in dependence on the direction of the cascade control.

Consequently, the control and regulation of the loop must meet stringent requirements; because of high dynamics, the increase and the decrease of the loop has been found to be the most problematic phase of loop regulation because oscillations are frequently unavoidable. In front of the loop exit side, the loop must be decreased by the loop control unit, i.e., the loop must be reduced to the value zero. In order to avoid that the front end of the rod or bar emerging from the roll stand hits the guide means especially during high speeds, it is necessary that the loop is reduced in time. Another problem is the fact that, at rolling speeds of above 20 m/sec., the control of the loop must be carried synchronously with the material flow with an accuracy of 1/10 of a second in order to avoid incorrect evaluations. Finally, in front of the rolling stock entry side into the roll stand, the loop between the individual stands must be in a stabilized state, which can be realized only with great difficulty particularly when the loop is formed at high speeds.

SUMMARY OF THE INVENTION

Therefore, it is the primary object of the present invention to provide a method and an arrangement of the above-described type which make it possible to avoid the disadvantages mentioned above and to simplify the formation of the loop without requiring complex drive technology, control technology and regulating technology.

In accordance with the present invention, the rolling stock emerging from the roll stand is allowed to drop as a result of gravity, the front end of the rolling stock is then deflected in the direction of the subsequent roll stand and the rolling stock is temporarily supported during the deflection phase until the front end of the rolling stock has entered the subsequent stand and the loop control means stabilizes the loop.

The method according to the present invention, i.e., allowing the loop to be formed automatically by the weight of the emerging rolling stock as a result of gravity, provides the surprising result that several advantages are achieved simultaneously. It is possible to operate without looping table and without loop lifting unit, so that very few movable parts are used and the parts are of simple construction, so that, in turn the manufacture, the maintenance and the operating costs are reduced. In addition, the method according to the present invention makes it possible to omit especially the two most dangerous phases of loop control, i.e., the increase and the decrease of the loop. The loop formed by gravity automatically exits at the end through the support. Since no loop lifting unit is present, there is also no danger that the exiting rolling stock is caused to "whip". The formation of the loop as a result of gravity reduces the requirements made of the dynamics of loop control, so that the control of the rate of rotation can be a one-quadrant control, while a four-quadrant control is usually used in known arrangements.

In accordance with a proposal of the present invention, the lowering phase is adjustable in dependence on the desired height of the loop. Accordingly, the maximum bending of the rolling stock due to the weight of the rolling stock can be preadjusted by more or less raising the support means which provides a support surface for the rolling stock during the deflection phase. Since the rolling stock does not have to be pulled over a loop lifting unit when the loop is formed as a result of gravity, it is possible to operate with lower loop heights than is usually the case; depending on the product, the loop height is only between approximately 20 to 100 mm. By adjusting the support means, supplemented by an appropriate preselection of the loop height, it is ensured that the loop formed as a result of gravity has no contact in the stabilized state with the support means.

The arrangement according to the present invention for carrying out the above-described method includes a support and guide means for at least the rear or downstream roll stand of two roll stands. The support and guide means is inclined downwardly and extends toward the front or upstream roll stand.

In accordance with a preferred embodiment according to the invention, the support and guide means is constructed as a guide channel. Thus, the front end of the rolling stock which is lowered as a result of its own weight meets the support and guide means, is centered as a result and is supported during the subsequent deflection phase during which the front end of the rolling stock is conducted into the subsequent stand.

In accordance with a further development of the present invention, the higher end of the support and guide means which faces the rear or downstream roll stand is arranged in a swivel bearing. Accordingly, the adjustment of the guide and support means or the guide channel can be achieved by swivelling. In the simplest form, the support and guide means is constructed as a welded structure. Since the guide and support means can be adjusted by swivelling, it is also easier to carry out a program change which would only make it necessary to readjust the degree of inclination of one or both guide channels.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

The single figure of the drawing schematically illustrates the arrangement for loop formation according to the present invention.

DETAILED DESCRIPTION OF THE PREFERRED EMBODIMENTS

The single figure of the drawing shows two successive roll stands I and II which are each schematically represented by an upper horizontal roll 2 and a lower horizontal roll 3, respectively. The roll stands are arranged in a finishing train or an intermediate train 1 of a small iron train or medium iron train, not shown.

In the illustrated embodiment, the front or upstream roll stand I as well as the subsequent rear or downstream roll stand II each have a support and guide means in the form of a guide channel 5 and 6, respectively. The guide channels 5 and 6 are constructed as welded components and are attached to a swivel bearing 4 so as to be adjustable. The guide channels 5 and 6 are hinged to the swivel bearings 4 so as to be downwardly inclined to form a V-shaped configuration.

The guide channel 6 hinged to the swivel bearing 4 of the rear roll stand II is sufficient for achieving the formation of a loop as a result of gravity as described below. The guide channel 5 of the front roll stand I merely has the purpose of guiding the emerging front end of the rolling stock essentially without whipping effect to the guide channel 6 of the rear roll stand II.

The individual phases of the loop formed automatically as a result of gravity due to the weight of the emerging rolling stock 7 are schematically designated in the drawing with phase 1, phase 2 and phase 3.

In phase 1 of the loop formation, the front end of the rolling stock 7 emerging from the front roll stand I assumes the shape indicated by a solid line. During this phase 1, the front end of the rolling stock 7 automatically drops down as a result of gravity due to the weight of the rolling stock. As soon as the rolling stock 7 makes contact with the guide channel 6 of the subsequent roll stand II, phase 2 having the shape of the curve indicated by a dotted line begins. In phase 2, the front end of the rolling stock 7 is deflected in the direction of the subsequent roll stand II and is simultaneously supported until the front end of the rolling stock 7 has been inserted between the horizontal rolls 2, 3 of the roll stand II. An inlet guide means 8 is provided for aiding in the insertion of the front end of the rolling stock 7 into the roll stand II. As soon as the front end of the rolling stock 7 has been grasped by the horizontal rolls 2 and 3 of the roll stand II, the loop resulting from gravity is stabilized by means of a loop control unit with a scanner which now begin to operate. The shape of the stabilized loop is represented by the broken line which is designated as phase 3.

Depending on the product, the loop height 9 is only between 20 to 100 mm. The rolling stock 7 which forms the loop resulting from gravity as indicated by phase 3 is physically in a stable state and the shape of bending of the rolling stock is also natural. After the necessary controlling steps have been carried out, the position of the rolling stock 7 which is maintained by the weight of the rolling stock also tends to produce less mechanical vibrations. The start-up operation requires much less time than in known arrangements because, as already explained above, the loop increase and loop decrease phases of the loop control are omitted. This makes it also unnecessary to synchronize between ejector, control, rolling stock travel and the release of the control unit. Consequently, this not only facilitates a much simpler operation sequence, but also leads to a much higher operational safety.

The invention is not limited by the embodiments described above which are presented as examples only but can be modified in various ways within the scope of protection defined by the appended patent claims.

I claim:

1. A method for forming a loop of rolling stock between a front roll stand and a rear roll stand in a rolling train in a controlled manner, the method comprising the steps of allowing the front end of the rolling stock emerging from the front roll stand to drop as a result of gravity, subsequently deflecting the front end of the rolling stock toward the rear roll stand and temporarily supporting the rolling stock during the step of deflecting the rolling stock until the front end of the rolling stock has entered the rear roll stand, and allowing the rolling stock to form a loop between the front and rear roll stands as a result of gravity without support and stabilizing the loop by means of a loop control unit.

2. The method according to claim 1, comprising adjusting the step of allowing the front end of the rolling stock to drop in dependence on a desired loop height.

3. An arrangement for forming a loop of rolling stock between a front roll stand and a rear roll stand in a rolling train, the arrangement comprising a support and guide means attached to the rear roll stand, the support and guide means being downwardly inclined and extending toward the front roll stand for temporarily deflecting a front end of the rolling stock toward the rear roll stand and for automatically forming a loop of rolling stock between the front roll stand and the rear roll stand as a result of gravity the support and guide means being withdrawn to allow the formed loop to suspend freely as the rolling stock moves from the front roll stand to the rear roll stand.

* * * * *